US008212741B2

(12) United States Patent
Raman et al.

(10) Patent No.: US 8,212,741 B2
(45) Date of Patent: Jul. 3, 2012

(54) DUAL DISPLAY DEVICE

(75) Inventors: Nalliah Raman, Singapore (SG); Gerben Johan Hekstra, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 666 days.

(21) Appl. No.: 11/915,743

(22) PCT Filed: May 29, 2006

(86) PCT No.: PCT/IB2006/051699

§ 371 (c)(1),
(2), (4) Date: Sep. 10, 2008

(87) PCT Pub. No.: WO2006/129263

PCT Pub. Date: Dec. 7, 2006

(65) Prior Publication Data

US 2009/0096710 A1 Apr. 16, 2009

(30) Foreign Application Priority Data

Jun. 1, 2005 (EP) ..... 05104754

(51) Int. Cl.
*G09G 5/00* (2006.01)

(52) U.S. Cl. ..... 345/1.1; 345/4; 345/204

(58) Field of Classification Search ..... 345/1.1–8, 345/102

See application file for complete search history.

(56) References Cited

U.S. PATENT DOCUMENTS 3,983,320 A * 9/1976 Ketcham et al. ..... 348/672
5,666,226 A 9/1997 Ezra
2002/0130830 A1 9/2002 Park
2003/0090455 A1 5/2003 Daly
2005/0157939 A1 * 7/2005 Arsenault et al. ..... 382/260
2005/0248592 A1 * 11/2005 Feng et al. ..... 345/690

FOREIGN PATENT DOCUMENTS

EP 0453030 B1 9/1995
WO WO 2004027695 A1 * 4/2004
WO WO2004049293 A1 6/2004

OTHER PUBLICATIONS

Edwin H. Land, "The Retinex Theory of Color Vision", Scientific American, Scientific American Inc., NY US., vol. 237, No. 6, Dec. 1977, pp. 108-120, 122, XP008041094.
Helge Seetzen et al., "High Dynamic Range Display Systems", Proceedings of ACM Siggraph 2004, Dec. 9, 2004, XP002405605.
G.Orsini et al.,, "A Modified Retinex for Image Contrast Enhancement and Dynamics Control", IEEE Int. Conf. on Image Processing, 2003, DEEI, University of Trieste, Italy.
Land et al., "Lightness and Retinex Theory", J. of the Optical Soc. of America, vol. 61, No. 1. Jan. 1971.

* cited by examiner

*Primary Examiner* — Stephen Sherman

(57) ABSTRACT

A dual display device for displaying an input image includes first and second displays. The first display is arranged for modulating an image from the second display. The dual display device further includes a processor having an image splitter which splits the input image into illumination and reflection images according to a retinex algorithm. The reflection image is displayed on the first display and the illumination image is displayed on the second display. Due to the series arrangement of the two displays, the input image is substantially recreated. The illumination image typically is a spatially low-resolution image derived from the input image.

20 Claims, 9 Drawing Sheets

11110011 — dw

P

Ndw

I

| | | | | |
|---|---|---|---|---|
| 0.9492 | 0.7621 | 0.6154 | 0.4057 | 0.0579 |
| 0.2311 | 0.4565 | 0.7919 | 0.9355 | 0.3529 |
| 0.6068 | 0.0185 | 0.9218 | 0.9169 | 0.8132 |
| 0.4860 | 0.8214 | 0.7382 | 0.4103 | 0.0099 |
| 0.8913 | 0.4447 | 0.1763 | 0.8936 | 0.1389 |

FIG.2A

| | | | | |
|---|---|---|---|---|
| 0.9743 | 0.8730 | 0.7845 | 0.6370 | 0.2406 |
| 0.4808 | 0.6756 | 0.8899 | 0.9672 | 0.5940 |
| 0.7790 | 0.1360 | 0.9601 | 0.9576 | 0.9018 |
| 0.6971 | 0.9063 | 0.8592 | 0.6405 | 0.0993 |
| 0.9441 | 0.6669 | 0.4198 | 0.9453 | 0.3727 |

$Isp = \sqrt{I}$

Avp = 0.6961

FIG.2B

C

G

| | | |
|---|---|---|
| 1/16 | 2/16 | 1/16 |
| 2/16 | 4/16 | 2/16 |
| 1/16 | 2/16 | 1/16 |

FIG.2C

Ip

| | | | | | | |
|---|---|---|---|---|---|---|
| 0.4565 | 0.2311 | 0.4565 | 0.7919 | 0.9355 | 0.3529 | 0.9355 |
| 0.7621 | 0.9492 | 0.7621 | 0.6154 | 0.4057 | 0.0579 | 0.4057 |
| 0.4565 | 0.2311 | 0.4565 | 0.7919 | 0.9355 | 0.3529 | 0.9355 |
| 0.0185 | 0.6068 | 0.0185 | 0.9218 | 0.9169 | 0.8132 | 0.9169 |
| 0.8214 | 0.4860 | 0.8214 | 0.7382 | 0.4103 | 0.0099 | 0.4103 |
| 0.4447 | 0.8913 | 0.4447 | 0.1763 | 0.8936 | 0.1389 | 0.8936 |
| 0.8214 | 0.4860 | 0.8214 | 0.7382 | 0.4103 | 0.0099 | 0.4103 |

FIG.2D

Ij = G*Ip

| | | | | |
|---|---|---|---|---|
| 0.5997 | 0.6281 | 0.6718 | 0.5626 | 0.4380 |
| 0.4640 | 0.5329 | 0.6956 | 0.6928 | 0.5963 |
| 0.4057 | 0.4959 | 0.7026 | 0.7326 | 0.6461 |
| 0.5720 | 0.5785 | 0.6179 | 0.5505 | 0.4504 |
| 0.6609 | 0.6030 | 0.5499 | 0.4589 | 0.3632 |

Av = 0.5708

FIG.2E

DUAL DISPLAY DEVICE

FIELD OF THE INVENTION

The invention relates to a dual display device for displaying an input image comprising input digital words, the dual display device comprising a first display, a second display and an image splitter, the first display being arranged for modulating an image from a second display.

The invention further relates to a method for displaying an input image and to a computer program product.

BACKGROUND OF THE INVENTION

Images viewed via a conventional display device can clearly be distinguished from the same images viewed in the real world. This is due to the dynamic range of conventional displays, which typically is insufficient to create the optical sensation of watching an image in the real world. Image enhancement methods have been developed to create a more lifelike impression of the image. Still, the limitations in the dynamic range of conventional display devices prevent even enhanced images to be perceived identical to the real world image.

In an ACM SIGGRAPH 2004 paper of Seetzen et al: "High dynamic range display systems" two designs of high dynamic range display systems are disclosed. In this paper two different dual display systems are shown which are capable of using an increased dynamic range of intensity levels for displaying images. This increased dynamic range provides a perception of the displayed image more similar to watching the same image in the real world. The dual display systems comprise a pixelated backlight and an LCD front panel. The dynamic range of the display system is substantially equal to the product of the dynamic range of the LCD panel and of the pixelated backlight. In the disclosed dual display systems a graphics processing unit splits the input image data into two substantially identical images by taking the square root of the normalized input image data. The graphics processing unit subsequently sends these two substantially identical images, preferably after gamma corrections and/or backlighting corrections, to both the pixelated backlight and to the LCD front panel.

The high dynamic range display system as proposed by Seetzen et al has not been optimized in respect of power consumption.

SUMMARY OF THE INVENTION

It is an object of the invention to provide a dual display device having reduced power consumption.

According to a first aspect of the invention the object is achieved with a dual display device in which the image splitter is constructed for splitting the input image according to a retinex algorithm into an illumination image and a reflection image. The illumination image is constituted of illumination digital words which are supplied, in operation, to the second display. The reflection image is constituted of reflection digital words which are supplied, in operation, to the first display.

The effect of the measures according to the invention is that the split of the input image using the retinex algorithm results in an illumination image in which the light intensity values of the illumination digital words change spatially more smoothly compared to the input digital words. A digital word is a single unit of a digital language in which each digital word defines a brightness and color of a pixel of an image. The illumination image can be considered a spatially low resolution image derived from the input image. The illumination image is supplied to the second display which can be considered as a backlight unit for the first display. Therefore, the first display is positioned in between the viewer and the second display. When driving the second display with the spatially low resolution illumination image typically less power is dissipated in the second display compared to driving the second display with a substantially identical image as the input image, as is done in the prior art. This is, for example, due to the fact that the spatial smoothing operation used to obtain the illumination image smoothes the light intensity values of the image locally which leads to a lower average of the light intensity for the entire image. Because the main part of the power dissipation of the dual display device happens in the pixelated backlight, a reduction of the power dissipation in the pixelated backlight results in an overall power consumption reduction of the dual display device.

The retinex algorithm was introduced in 1971 by Land and McCann ("Lightness and Retinex theory", J. of the Optical Soc. Of America, vol. 61, no. 1, Jan. 1971) and has since been used as image manipulation algorithm in many different applications. The retinex algorithm defines an image to be a pixel-by-pixel product of ambient illumination (also indicated as illumination image) and object reflection (also indicated as reflection image). In the ambient illumination of the image the pixel to pixel light intensity variations change smoothly and thus the ambient illumination typically is a spatial low resolution version of the image. The object reflection can, for example, be calculated via a pixel-by-pixel division of the image by the ambient illumination. Typically, the retinex algorithm is used for image data compression, in which, for example, the ambient illumination is compressed using the low spatial variation of the light intensity values. The inventors have realized that the retinex algorithm, next to the typical data compression applications, also beneficially can be used in dual display devices to achieve a reduction of the power consumption of the dual display device.

A further benefit of the measures according to the invention is that the split of the input image using the retinex algorithm improves a viewing angle characteristic of the dual display device. The dual display device reconstructs the input image by filtering a light intensity emitted by a pixel of the second display according to the illumination digital words with a programmed transparency of a pixel of the first display according to the reflection digital words. With intensity is meant, the brightness and color of the pixel. When the viewing angle with respect to the first display is substantially perpendicular, a particular pixel of the first display is aligned, for example, to a first pixel of the second display. When the viewing angle is changed, the particular pixel of the first display may not be aligned with the first pixel of the second display, but with a second pixel of the second display, for example, being a neighboring pixel of the first pixel. This may lead to errors in the reconstruction of the input image, also known as parallax errors of a dual display system. The parallax errors are dependent on the viewing angle with respect to the first display. When the input image is split between the first display and the second display using the retinex algorithm, the light intensity values in the second display spatially change more smoothly. This means that the difference between the light intensity emitted by the first pixel and the light intensity emitted by the second pixel in the second display typically is relatively small. Thus, when using the retinex algorithm, the error in reconstructing the input image by combining the particular pixel of the first display with the second pixel of the second display instead of with the first pixel of the second display is relatively small, typically reducing parallax errors.

An additional benefit of the features according to the invention is that additional luminance levels are created which were not present in the input image by applying the retinex algorithm to split the input image in the first image and the second image in the dual display device. The dynamic range of conventional displays typically is 8 bits, which results 256 different luminance levels, also indicated as gray levels, which can be displayed by the conventional display. The dynamic range of the dual display device theoretically is, for example, 16 bits (65,536 luminance levels) if both the first and the second display have a dynamic range of 8 bits. Due to the fact that the first display is arranged for modulating the image from the second display, the arrangement of the first and second display can be considered as a hardware multiplication of the illumination image and the reflection image. The dual display device according to the invention comprises the image splitter which performs the retinex algorithm for splitting the input image into the illumination image and the reflection image. The illumination image which is displayed on the second display of the dual display device is different from the reflection image which is displayed on the first display of the dual display device. The recombination via the first display modulating the image from the second display thus results in gray levels to be displayed in the displayed image which were not present in the input image and in-between gray levels are created. Thus, by performing the retinex algorithm for splitting the input image into an illumination image and a reflection image the image displayed on a dual display device comprises more gray-levels than the input image.

In contrast, the known dual display device comprises a graphics processing unit which splits the input image data into two substantially identical images by taking the square root of the normalized input image data. The normalized data of the two substantially identical images is converted into 8 bit images which are displayed on the first display and the second display to obtain a prior art displayed image. The prior art displayed image typically comprises an increased gray-level range between the lowest gray level which can be displayed by the dual display device and the highest gray level which can be displayed by the dual display device. This gray-level range is increased from 255 different possible gray-levels up to 65535 different possible gray-levels. However, due to the displaying of two substantially identical images at the first display and the second display of the dual display device, the recombination via the first display modulating the image from the second display still substantially comprises 256 different gray levels as were present in the input image.

In an embodiment of the system, the image splitter comprises a spatial low-pass filter to generate the illumination digital words from the input digital words. Because the spatial low-pass filter can be applied relatively easy, the computation time of the dual display device to perform the retinex algorithm can be reduced. The reduction of the computation time may, for example, enable the retinex algorithm to be more easily applied to video streams.

In an embodiment of the system, the digital word comprises a group of sub-words, together defining a luminance and color of the pixel. The dual display device comprises a word splitter for splitting the input digital word into a luminance sub-word representing the luminance of the pixel and color sub-words representing the color of the pixel. The image splitter is constructed for applying the retinex algorithm only to the luminance sub-words. The input image comprises a stream of input digital words which each comprise a group of sub-words which together define the luminance and color of the associated pixel of the image to be displayed.

For example, the input digital words may be constituted by a group of RGB sub-words. The RGB sub-words represent light intensity values of three primary colors of a RGB color space. The group of RGB sub-words comprises a first sub-word which represents the light intensity value of a first primary color, for example, the primary color red. The group of RGB sub-words further comprises a second sub-word which represents the light intensity value of a second primary color, for example, the primary color green. The group of RGB sub-words also comprises a third digital word which represents the light intensity value of a third primary color, for example, the primary color blue. If the retinex algorithm is applied to the input image constituted by groups of RGB sub-words which, for example, define a RGB color space, unnatural color effect may result.

Therefore, in a preferred embodiment of the system according to the invention, the dual display device is constructed for converting the input image from a RGB color space to, for example, a YUV color space. A group of RGB sub-words is converted into a Y-value which is a luminance sub-word which represents the overall luminance of the group of RGB sub-words and is converted into U- and V-values which are color sub-words which represent a color component of the group of RGB sub-words. In another preferred embodiment of the system according to the invention, the dual display device is constructed for converting the input image from the RGB color space to, for example, a HSV color space. A group of RGB sub-words is converted into a V-value (Value) which is a luminance sub-word which represents the overall luminance of the group of RGB sub-words and is converted into S- and H-values (Saturation and Hue, respectively) which are color sub-words which represent a color component of the group of RGB sub-words. By applying the retinex algorithm only to the luminance sub-words of the input image (for example, the Y-value in the YUV color space or the V-value in the HSV color space), color artifacts are avoided. Also other splitting algorithms known to the person skilled in the art which result in splitting the input image into luminance information and color information, may be applied without departing from the scope of the invention.

In an embodiment of the system, the dual display device further comprises a detail enhancer for performing detail enhancement algorithms on the reflection image before being supplied to the first display. Detail enhancement algorithms as such are well known in the art, for example, (non)linear remapping, image sharpening, gamma correction, etc. Due to the splitting of the input image according to the retinex algorithm, known detail enhancement algorithms can be performed on the reflection image while the overall illumination variations within the image are largely preserved. This typically results in a sharper image while largely preserving brightness variations of the original image.

In a preferred embodiment of the system, the detail enhancer is performing histogram equalization. Histogram equalization typically redistributes the available gray-levels in an image according to a predefined algorithm to obtain an improved distribution of the available gray-levels across the range of gray-levels which can be displayed by the display. When performing histogram equalization on the reflection image, the gray-levels within the reflection image are changed due to the redistribution. By combining the reflection image with the illumination image via the first display which modulates the image from the second display, many new gray levels which were not present in the input image are displayed by the dual display device. Thus, splitting the input image into an illumination image and a reflection image via the retinex algorithm and subsequently performing histogram equalization on the reflection image substantially creates more gray levels in the displayed image compared to the gray levels of the input image and results in an improved usage of the dynamic range of the dual display device.

In an embodiment of the system, the dual display device further comprises a contrast enhancer for performing contrast enhancement algorithms on the illumination image before being supplied to the second display. Contrast enhancement algorithms as such are well known in the art. Due to the splitting of the input image according to the retinex algorithm, known contrast enhancement algorithms can be performed on the input image separate from the possible detail enhancement algorithms.

In a preferred embodiment of the system, the contrast enhancer is performing histogram equalization. When performing histogram equalization on the illumination image, the gray-levels within the illumination image are changed due to the redistribution. By combining the reflection image with the illumination image via the first display modulating the image from the second display again many new gray levels which were not present in the input image are displayed by the dual display device. Thus, splitting the input image into an illumination image and a reflection image via the retinex algorithm and subsequently performing histogram equalization on the illumination image creates more gray levels in the displayed image compared to the gray levels of the input image and results in an improved usage of the dynamic range of the dual display device and consequently, in an improved quality of the displayed image.

In an embodiment of the system, the first display has a first spatial resolution and the second display has a second spatial resolution which is lower than the first spatial resolution. The cost of spatial low resolution displays is typically lower than the cost of spatial high resolution displays. Because the illumination image is a spatial low resolution image, it can be displayed on a spatial lower resolution image with little impact on the quality of the illumination image to be displayed. Thus using a display having a lower spatial resolution as the second display typically reduces the cost of the dual display device with little impact on the quality of the displayed image.

These and other aspects of the invention are apparent from and will be elucidated with reference to the embodiments described hereinafter.

BRIEF DESCRIPTION OF THE DRAWINGS

In the drawings:

FIGS. 2A to 2E show a split of the input image into a second image to be displayed at the second display according to the prior art and into an illumination image according to the invention.

The figures are purely diagrammatic and not drawn to scale. Particularly for clarity, some dimensions are exaggerated strongly. Similar components in the figures are denoted by the same reference numerals as much as possible.

DETAILED DESCRIPTION

FIGS. 1A to 1D show plan views of embodiments of the dual display device DD1, DD2 according to the invention. The dual display device DD1, DD2 comprises a first display D1 which is arranged as an optical filter of programmable transparency for modulating the image from a second display D2, D3. The dual display device DD1, DD2 further comprises a processor Pr1 which processes the input image I to be displayed on the dual display device DD1, DD2.

Figure 1B:
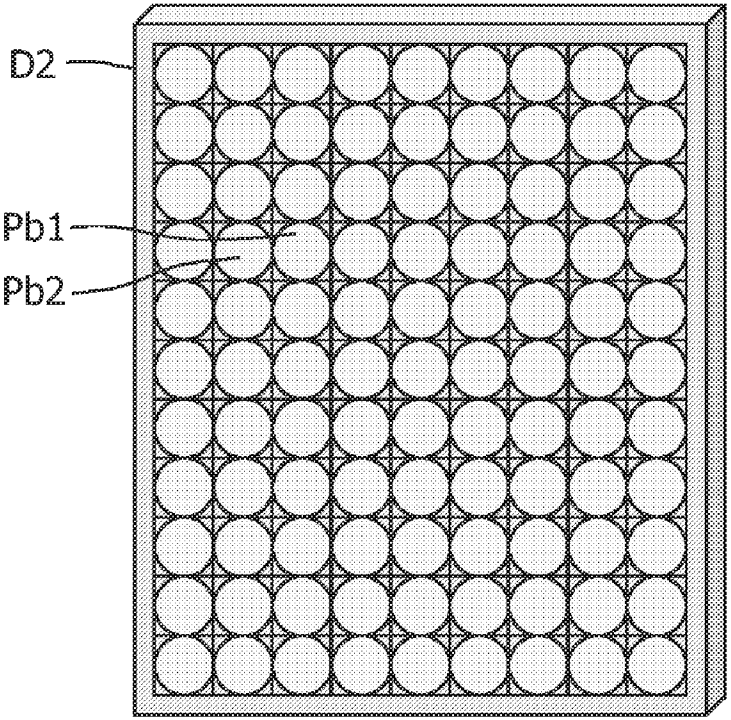
FIGS. 1A to 1D show plan views of embodiments of the dual display device according to the invention.
Figure 1A:
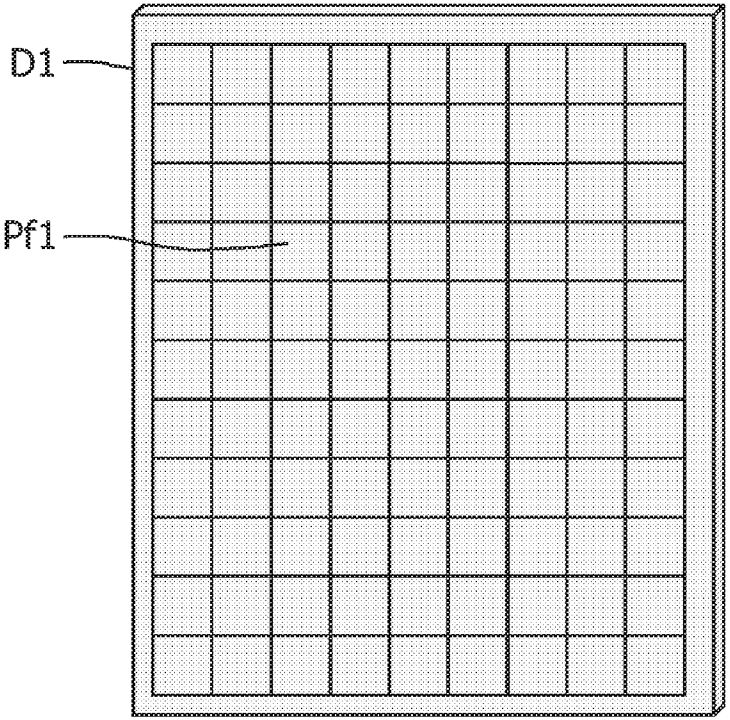

FIG. 1A shows the first display D1 which is a diagrammatic representation of a Liquid Crystal Display (also further referred to as LCD) panel D1. The LCD panel D1 comprises an array of LCD pixels Pf1 in which each LCD pixel Pf1, for example, comprises three sub-pixels (not shown). Each sub-pixel comprises a liquid crystal cell and a color filter. The color filters of the sub-pixels within one LCD pixel Pf1 preferably transmit different colors and are typically chosen such that substantially every color within a standardized color gamut (for example, EBU or NTSC color standard) can be created by selecting a specific transparency for every liquid crystal cell in combination with the associated color filter. Each liquid crystal cell of the LCD panel D1, for example, distinguishes 8 bit (256) different transparency levels which are equivalent to an 8 bit dynamic range of the LCD panel D1. The number of LCD pixels Pf1 per surface area determines the spatial resolution of the LCD panel D1.

FIG. 1B shows a second display D2 being a diagrammatic representation of a panel comprising an array of light sources, for example, a Light Emitting Diode (further also referred to as LED) panel D2. The LED panel D2 comprises an array of LEDs Pb1, Pb2 which emit, for example, substantially white light. In the example shown in FIG. 1B the number of LEDs Pb1, Pb2, in the LED panel D2 is equal to the number of LCD pixels Pf1 in the LCD panel D1 resulting in the LED panel D2 having the same spatial resolution as the LCD panel D1. Alternative designs may comprise an LED panel D2 in which the spatial resolution of the LED panel D2 is lower than the spatial resolution of the LCD panel D1. Each LED Pb1, Pb2 in the LED panel D2, for example, distinguishes 8 bit (256) different emission intensity levels which can be addressed, resulting in an 8 bit dynamic range of the LED panel D2.

Figure 1C:
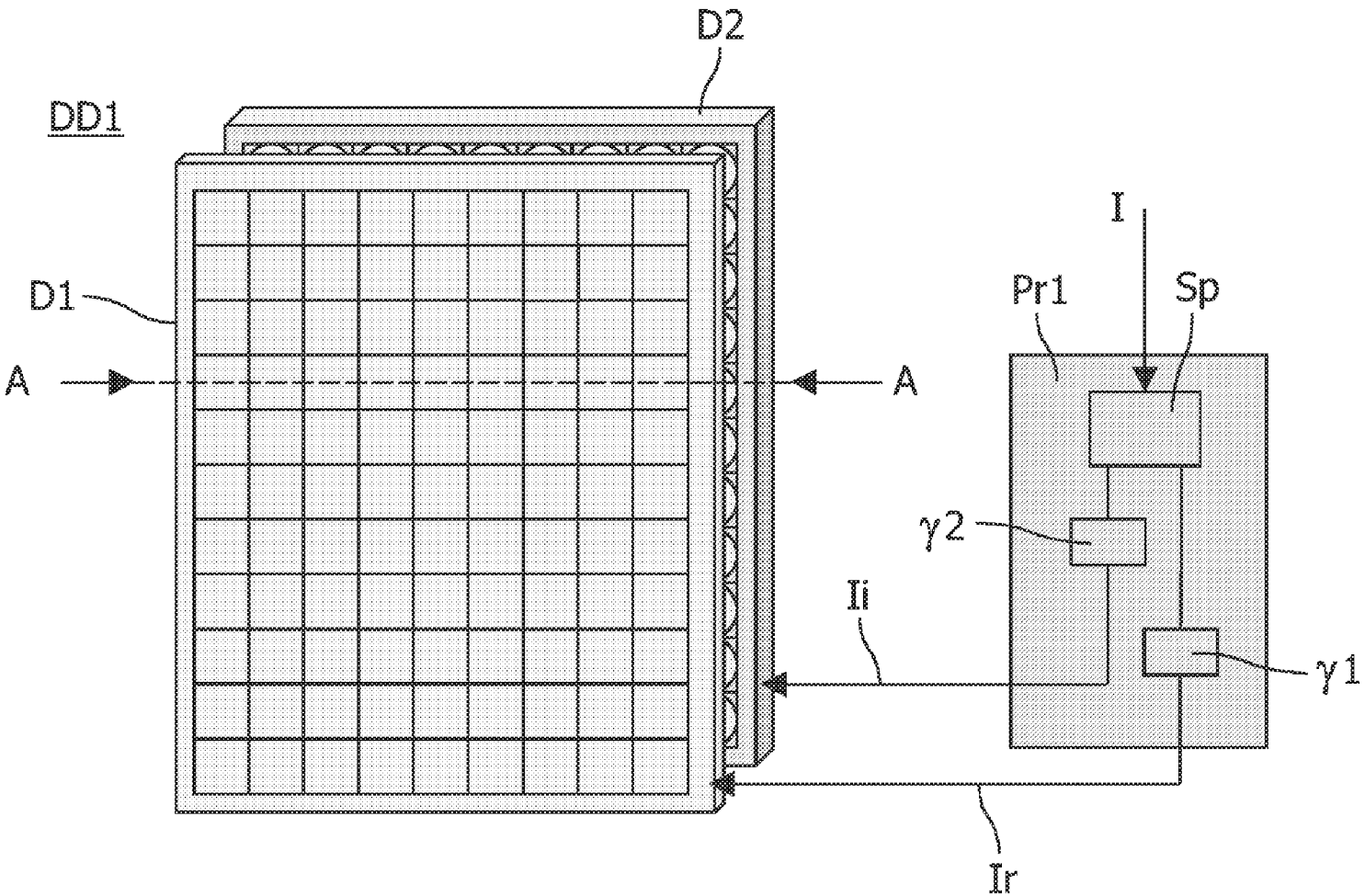

FIG. 1C shows an embodiment of the dual display device DD1 according to the invention. The LCD panel D1 is arranged between the LED panel D2 and a viewer (not shown). The LCD pixels Pf1 (FIG. 1A) are aligned with the LEDs Pb1, Pb2 (FIG. 1B) of the LED panel D2 such that one LED Pb1 emits light toward the viewer substantially via the associated LCD pixel Pf1. The dual display device DD1 further comprises the processor Pr1 which receives the input image I and processes the input image I for displaying the input image I at the dual display device DD1. The processor Pr1 comprises an image splitter Sp for splitting the input image I into an illumination image Ii and a reflection image Ir. The image splitter Sp is constructed to split the input image I according to the retinex algorithm. In the embodiment shown in FIG. 1C the processor further comprises first gamma circuitry γ1 which corrects the reflection image Ir with an inverse response function of the first display D1 before the reflection image Ir is displayed on the LCD panel D1. The processor also comprises second gamma circuitry γ2 which corrects the illumination image Ii with an inverse response function of the second display D2 before the illumination image Ii is displayed on the LED panel D2. The LCD pixel Pf1 in the LCD panel D1 acts as programmable filter for the associated LED Pb1 of the LED panel D2. Because both the LED panel D2 and the LCD panel D1 both have 8 bit dynamic range, the dual display device DD1 is theoretically able to display a 16 bit dynamic range of luminance levels (also called gray levels). An actual dual display device DD1 only can display approximately a 15 bit range due to redundancies in possible luminance level combinations between the LED panel D2 and the LCD panel D1 (for example, filtering luminance level 5 of the LED panel D2 with a luminance level 2 of the LCD panel D1 is equivalent to filtering luminance level 2 of the LED panel D2 with a luminance level 5 of the LCD panel D1).

The input image I typically comprises a stream of input digital words dw (see FIG. 2) which define a brightness and color of a pixel of an image. The processor Pr1 receives the stream of input digital words dw and splits the input digital words dw according to the retinex algorithm using the image splitter Sp into illumination digital words and reflection digital words. The illumination digital words are corrected for the response of the LED panel D2 using the second gamma circuitry γ2 and are supplied to the LEDs Pb1, Pb2 of the LED panel D2. The illumination digital words determine the light emission intensity of the LEDs Pb1, Pb2 within the LED panel D2. The reflection digital words are corrected for the response of the LCD panel D1 using the first gamma circuitry γ1 and are supplied to the LCD pixels Pf1 of the LCD panel. The reflection digital words determine the transmission of the LCD pixels Pf1 within the LCD panel D1.

The illumination image Ii which results from the retinex algorithm typically represents a spatially low resolution version of the input image I. This means that the variations of the light emission intensity of the LEDs Pb1, Pb2 within the LED panel D2 are spatially smoothed. In the known dual display device a graphics processing unit (not shown) splits the input image I into a first and a second image by taking the square root of the normalized digital words Ndw (calculation of the normalization of the digital words is explained later using FIG. 2) of the input image I resulting in substantially identical images supplied to the first display D1 and the second display D2. Typically a mean light emission Av (calculation of the mean light emission is explained later using FIG. 2) of the LED panel D2 displaying the spatially smoothed image is lower than the mean light emission Avp (calculation of the mean light emission is explained later using FIG. 2) of the LED panel D2 displaying an image representing the square root of the normalized digital words Ndw of the input image I. This is shown via a numerical example in FIG. 2. Because the main part of the power dissipation of the dual display device DD1 occurs in the LED panel D2, a reduction of the mean light emission Av results in an overall power consumption reduction of the dual display device DD1.

In a preferred embodiment the spatial resolution of the LED panel D2 is lower than the spatial resolution of the LCD panel D1. When using a display having a reduced spatial resolution for displaying an image, errors are expected due to interpolation between pixel values of the displayed image. However, the error when displaying the illumination image Ii using a LED panel D2 having a reduced resolution is expected to be minor, because the illumination image Ii is a spatially low resolution image derived from the input image I. The benefit when using a display having a reduced spatial resolution is that the dual display device DD1 typically can be made less expensive.

In a preferred embodiment the LCD panel D1 is replaced by a digital mirror device (not shown). The digital mirror device typically comprises an array of micro mirrors which can be moved or switched on and off at high frequency. A pixel of an image which is switched off more frequent reflects a darker gray level compared to a pixel of an image which is switched off less frequent. In this way different gray levels can be generated for each pixel of the image. Typically the digital mirror device can reflect pixels of the image up to 1024 different gray levels. The digital mirror device is aligned with the LEDs Pb1, Pb2 of the LED panel D2 such that one LED Pb1 emits light toward the digital mirror device which reflects (part of) the light typically toward a projection screen from which the viewer can watch the image. The processor Pr1 receives the input image I and splits the input image I into the illumination image Ii which is provided to the LED panel D2 and into the reflection image Ir which is provided to the digital mirror device.

Figure 1D:
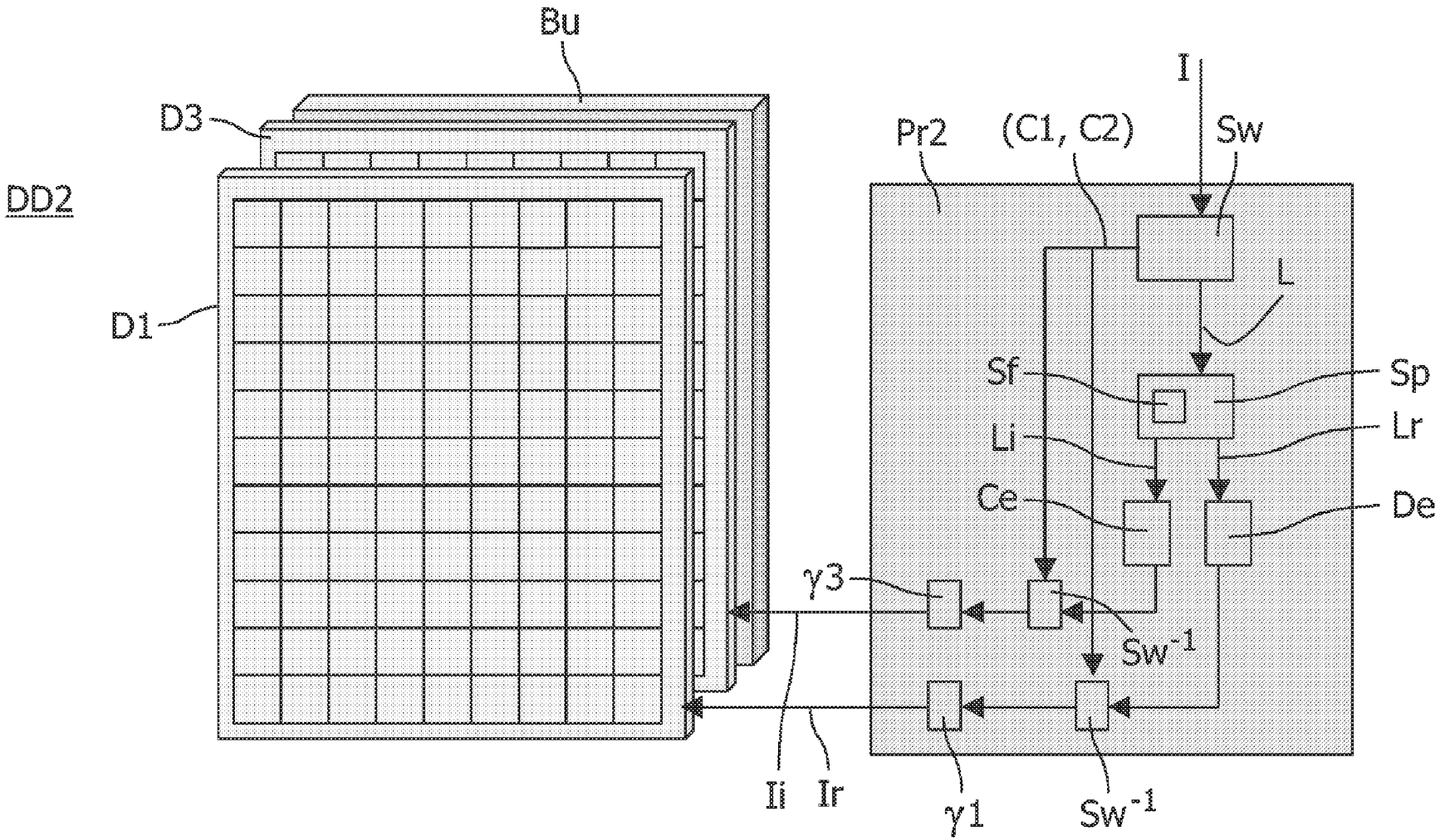

FIG. 1D shows a further embodiment of the dual display device DD2 according to the invention. In this embodiment, the LED panel D2 (FIG. 1C) has been replaced by a second LCD panel D3 which is used to modulate light from a backlight unit Bu. The second LCD panel D3 is arranged between the LCD panel D1 and the backlight unit Bu. Each one of the LCD pixels Pf1 (FIG. 1A) are aligned with an associated LCD pixel (not shown) of the second LCD panel D3 such that the associated LCD pixel emits light toward the viewer substantially via the LCD pixel Pf1. The dual display device DD2 further comprises a processor Pr2 which receives the input image I and processes the input image I for displaying the input image I at the dual display device DD2. The input image I typically comprises a stream of input digital words dw (see FIG. 2) which each comprise a group of sub-words (not shown) which together define a luminance and color of the associated pixel of the input image I. The processor Pr2 comprises a word splitter Sw which converts the input digital words of the input image I into luminance sub-words L which represent the luminance of a pixel and into color sub-words C1, C2 which represent the color of the pixel and subsequently separates the luminance sub-words L from the color sub-words C1, C2. The processor Pr2 is constructed to deliver the color sub-words C1, C2 to two word recombiners $Sw^{-1}$ and deliver the luminance sub-words L to the image splitter Sp. The image splitter Sp splits the luminance sub-words L into illumination luminance sub-words Li and reflection luminance sub-words Lr, equivalent to the image splitter described in FIG. 1C. The processor Pr2 shown in FIG. 1D furthermore comprises, for example, a contrast enhancer Ce which performs contrast enhancement algorithms on the illumination luminance sub-words Li. The processor Pr2 also, for example, comprises a detail enhancer De which performs detail enhancement on the reflection luminance sub-words Lr. Contrast enhancement algorithms, such as (non)linear stretching, and detail enhancement algorithms, such as histogram equalization, are well known in the art. In the arrangement shown in FIG. 1D, the illumination luminance sub-words Li and the reflection luminance sub-words Lr are recombined with the color sub-words C1, C2 after the contrast enhancement and detail enhancement have been performed via the word recombiner $Sw^{-1}$ which results in the illumination image Ii and the reflection image Ir. Contrast enhancement and/or detail enhancement can also be performed at a different location within the processor Pr2 which is obvious to the person skilled in the art. The processor Pr2 preferably also comprises first gamma circuitry γ1 which corrects the reflection image Ir with an inverse response function of the LCD panel D1 and third gamma circuitry y3 which correct the illumination image Ii with an inverse response function of the second LCD panel D3.

In a preferred embodiment the image splitter Sp comprises a spatial low-pass filter Sf which performs a spatial convolution operation on the input luminance sub-words L, for example, using a kernel function G (FIG. 2C), for example, a Gaussian kernel function G (see FIG. 2C). The benefit of using the Gaussian kernel function G is that it simplifies the computation required to perform the retinex algorithm which results in reduced computation time in the processor Pr2. This reduced computation time enables the retinex algorithm to be applied to, for example, video streams. On the other hand, the simplification of the computation reduces computation requirements of the processor Pr2 which, for example, as a result can be made cheaper.

The Input image I typically comprises input digital words dw (FIG. 2A) comprising groups of sub-words, for example, comprises a group of RGB sub-words which represent light intensity values of three primary colors of the RGB color space. Each one of the RGB sub-words is, for example, supplied to the sub-pixel of the LCD pixel Pf1 having a color filter which corresponds to the primary color represented by the RGB sub-word. The word splitter Sw converts the input digital words dw into luminance sub-words L and into color sub-words C1, C2. Several conversion algorithms are known in the art, such as the conversion of the RGB color space to a YUV color space, in which the Y-sub-words represent the luminance of the group of sub-words and the U- and V-sub-words represent the color of the group of sub-words. Another example is the conversion of the RGB color space into a HSV color space, in which the V-sub-words (also known as Value) represent the luminance of the group of sub-words and the S- and H-sub-words (also known as Saturation and Hue respectively) represent the color of the group of sub-words. The luminance sub-words L (or according to the mentioned examples, the Y-sub-words or the V-sub-words) are split into illumination luminance sub-words Li and reflection luminance sub-words Lr according to the retinex algorithm. The benefit of applying the retinex algorithm only to the luminance sub-words L of the input image I is that color artifacts in the displayed image of the dual display device DD2 are avoided. By recombining the color sub-words C1, C2 with the illumination luminance sub-words Li and the reflection luminance sub-words Lr the illumination image Ii and the reflection image Ir are generated respectively which are supplied to the second LCD panel D3 and the LCD panel D1 respectively.

FIGS. 2A to 2E show a split of the input image I into a second image Isp to be displayed at the second display D2, D3 according to the prior art and into an illumination image Ii according to the invention.

In FIG. 2A a two-dimensional array of normalized digital words Ndw is shown representing an input image I. Each one of the normalized digital words Ndw within the two-dimensional array represents a normalized value of a corresponding digital word dw of the input image I. For the input digital word dw (being a 8 bit digital word) in the upper left corner the corresponding normalized digital word Ndw is shown. This conversion, being well known to the person skilled in the art, converts the 8-bit digital word dw (for example: 11110011) into a decimal word (for example: 11110011→243) and subsequently into a normalized digital word Ndw (for example: 243/256=0.9492). The remaining normalized digital words Ndw of the two-dimensional array have been derived from corresponding input digital words dw of the input image I.

In FIG. 2B a two-dimensional array of second image words (normalized) is shown representing the second image Isp according to the prior art. Each element in the two-dimensional array is calculated by taking the square root of the corresponding normalized digital word Ndw of the input image I of FIG. 2A (for the upper left corner of the array shown in FIGS. 2A and 2B this results in: $\sqrt{0.9492}=0.9743$). This second image Isp according to the prior art is supplied to the second display D2, D3 of the dual display device DD1, DD2. The average light Avp which will be emitted by the second display D2, D3 when displaying the second image Isp according to the prior art is determined by taking the average of the calculated second image words of the two-dimensional array.

In FIG. 2C a Gaussian kernel function G is shown as an example of a kernel function. The Gaussian kernel function G is a spatial filter which spatially smoothes the intensity levels of neighboring pixels P (FIG. 2A) present in an image using a weight distribution within the kernel function which resembles a Gaussian function. The Gaussian kernel function G shown in FIG. 2C determines the average of a 3×3 array of input digital words dw. A center element C of the 3×3 Gaussian kernel function G is moved across the two-dimensional array of input digital words dw (or normalized digital words Ndw) and replaces the input digital word dw which corresponds to the center element C by the calculated average of the Gaussian kernel function G using a Gaussian type weight distribution. Also different types of kernel functions may be used without departing from the scope of the invention. To be able to apply the Gaussian kernel function G to the two-dimensional array of normalized digital words Ndw, as shown in FIG. 2A, edge digital words of the two-dimensional array of normalized digital words Ndw must be added, which is also known as padding. The padding operation converts the two-dimensional array of normalized digital words Ndw, being (in this example) a 5×5 array of normalized digital words Ndw, into a two-dimensional array of padded image Ip (FIG. 2D), being a 7×7 array of normalized digital words Ndw. A typical example of the padding operation is shown in FIG. 2D in which the second column in the two-dimensional array of normalized digital words Ndw in FIG. 2A is copied to create a new border before the first column of the two-dimensional array of normalized digital words Ndw (as is indicated in FIG. 2D for the first column of the new 7×7 array of padded image Ip with 5 dashed arrows). The fourth column of the two-dimensional array of normalized digital words Ndw in FIG. 2A is copied to create a new border after the fifth column of the two-dimensional array of normalized digital words Ndw. The second row of the two-dimensional array of normalized digital words Ndw in FIG. 2A is copied to create a new border above the first row of the two dimensional array of normalized digital words Ndw. And the fourth row of the two-dimensional array of normalized digital words Ndw in FIG. 2A is copied to create a new border below the fifth row of the two-dimensional array of normalized digital words Ndw. To complete the new 7×7 array of the padded image Ip the corner pixels of the 7×7 array are copied from the normalized digital words Ndw being located at the diametrically opposite side of the corner pixels of the original 5×5 array of FIG. 2A (as is indicated in FIG. 2D for the first column of the new 7×7 array of padded image pixels Ip with the dash-dot arrows). Of course, other padding operations known to the person skilled in the art may be applied without departing from the scope of the invention.

FIG. 2E shows the illumination image Ii resulting from applying the Gaussian kernel function G to the padded image Ip of FIG. 2D. Large intensity variations within the image have been smoothed by performing the Gaussian kernel function G. The average light Av which will be emitted by the second display D2, D3 when displaying the illumination image Ii according to the invention is determined by taking the average of the elements in the two-dimensional array which are calculated by applying the Gaussian kernel function G, via the padded image Ip, from the corresponding normalized digital words Ndw.

Typically the average light output when displaying an image in which the light intensity values of the pixels have been smoothed spatially is lower compared to the average light output of the original image, even when the original image is manipulated by taking the square root of the individual pixel values. This is also shown in the numerical example of FIG. 2 in which the average light output Avp (Avp=0.6961) when splitting the input image I into the second image Isp according to the prior art is clearly larger compared to the average light output Av (Av=0.5708) when splitting the input image I into the illumination image Ii according to the invention.

Figure 3:
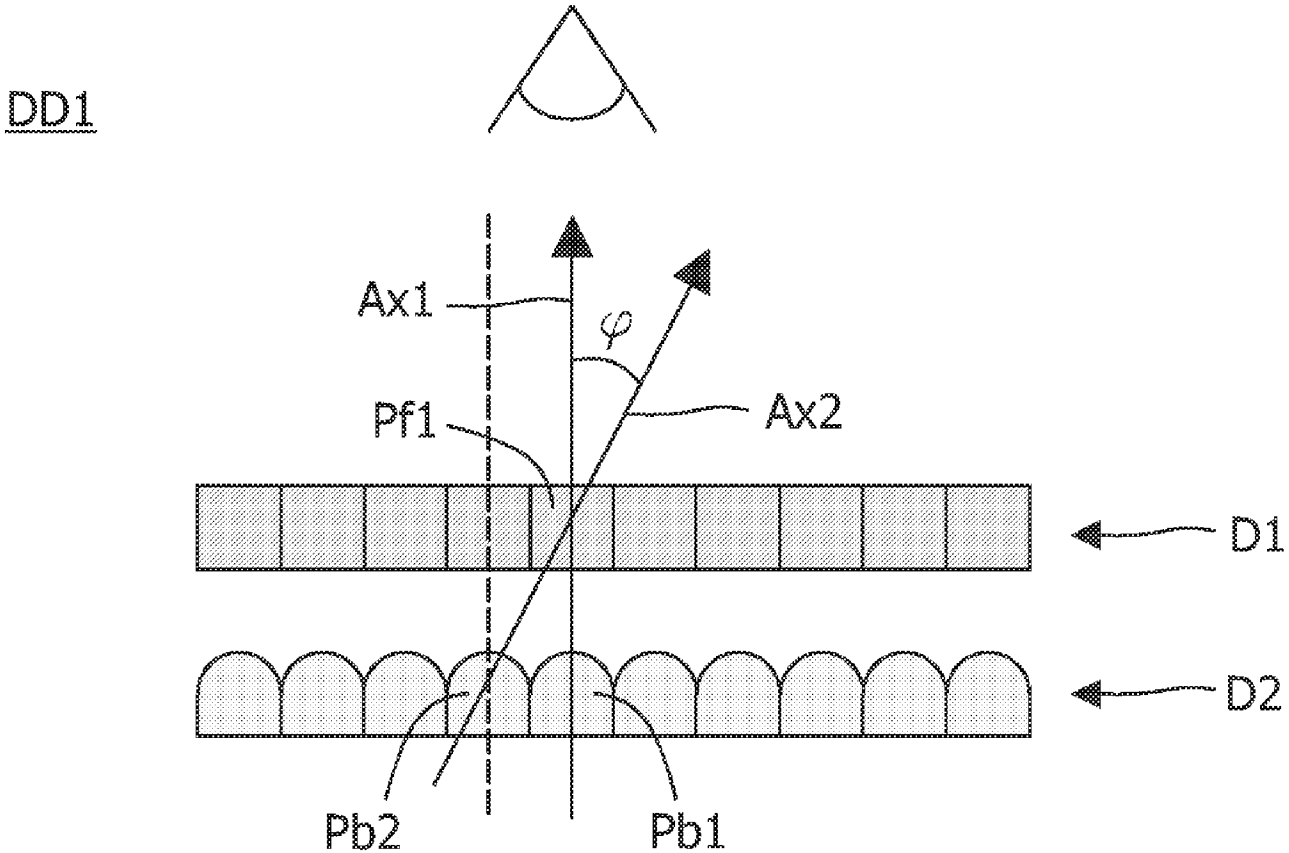
FIG. 3 shows a parallax error which may occur in a dual display device.

FIG. 3 shows a cross sectional view of the dual display device DD1 as shown in FIG. 1C along the line AA. In this cross sectional view the LCD pixel Pf1 of the LCD panel D1 is aligned along a first viewing axis Ax1 with the first LED Pb1 of the LED panel D2. The first viewing axis Ax1 is substantially perpendicular to the LCD panel D1 of the dual display device DD1. When the dual display device DD1 is viewed along a second viewing axis Ax2 at an angle $\phi$ with respect to the first viewing axis Ax1, the LCD pixel Pf1 of the LCD panel D1 is not aligned to the first LED Pb1 of the LED panel D2, but to the second LED Pb2, being a neighboring LED of the first LED Pb1. The light intensity seen by a viewer along the first viewing axis Ax1 typically is different from the light intensity viewed along the second viewing axis Ax2 and thus the image viewed along the first axis Ax1 typically is different from the image viewed along the second axis Ax2. This error is called parallax and may occur in dual display devices DD1, DD2.

In a dual display device DD1, DD2 according to the invention, the image displayed on the second display D2, D3 of the dual display devices DD1, DD2 is determined by splitting the input image I according to the retinex algorithm to obtain the illumination image Ii. The illumination image Ii typically is a spatially low resolution version of the input image I. In a spatially low resolution images the difference between the light intensity value of a pixel and a neighboring pixels typically is small. This means that the difference between light emitted by the first LED Pb1 and the second or neighboring LED Pb2 is relatively small, which results in a relatively small parallax error when viewing the dual display device DD1, DD2 along an axis other than the first viewing axis Ax1. Therefore, the splitting of the input image I according to the retinex algorithm results in a reduced parallax error in dual display devices DD1, DD2.

Figure 4A:
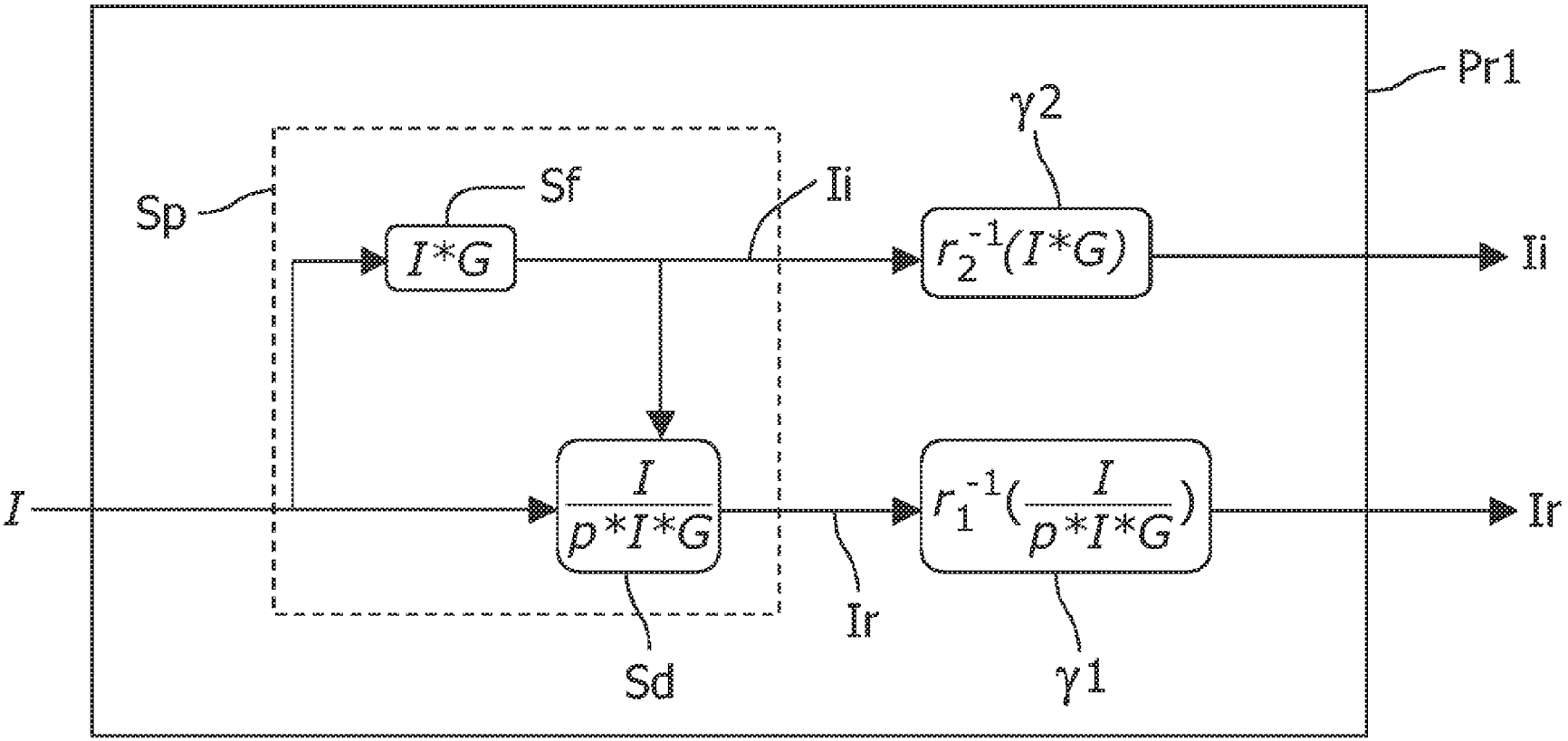
FIGS. 4A and 4B show block diagrams indicating the processing steps taken by the processor.
Figure 4B:
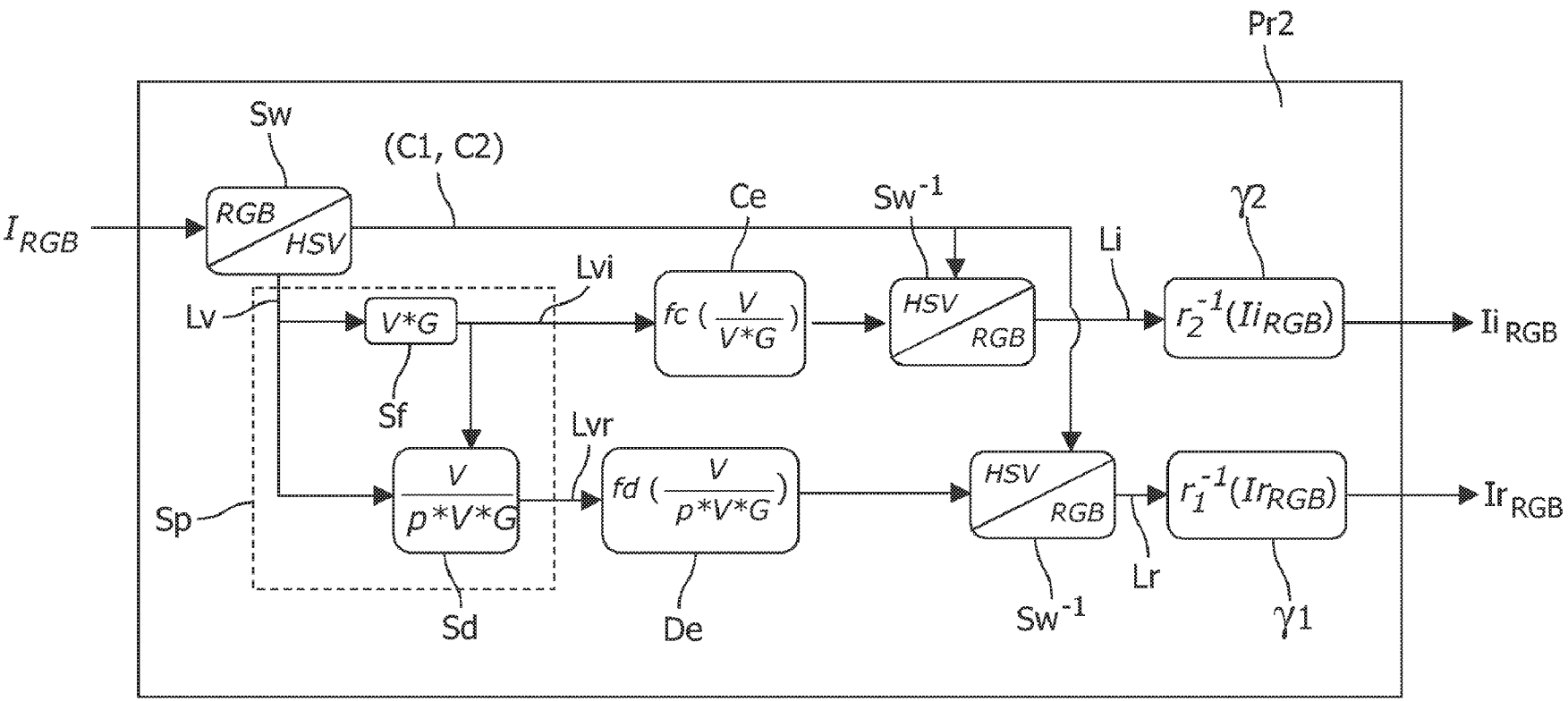

FIGS. 4A and 4B show block diagrams indicating the processing steps taken by the processor Pr1, Pr2. In FIG. 4A the processing steps as performed by the processor Pr1 are shown. The processor Pr1 receives the input image I. The input image I is split into the illumination image Ii and the reflection image Ir via the image splitter Sp. The image splitter Sp performs the retinex algorithm by convolving the Gaussian kernel function G with the input image I using the spatial low-pass filter Sf as already shown in FIGS. 2A, D and E. The image splitter Sp further comprises an image divider Sd which generates the reflection image Ir by dividing the digital word of the input image I with the corresponding digital word of the illumination image Ii from the spatial low-pass filter Sf. Of course alternative methods of calculating the reflection image are possible without departing from the scope of the invention, for example, calculating the reflection image using the following function: reflection image Ir=inverse log(log (input image I)−log(illumination image Ii)). The image divider Sd further comprises a Point Spread Function (further referred to as PSF) p. The PSF p represents an emission characteristic of light emitted from a pixel of the second display D2, D3 (FIG. 1) to pixels of the first display D1 (FIG. 1). Due to a finite distance between the first display D1 and the second display D2, D3, light emitted by a pixel of the second display D2, D3 towards a corresponding pixel in the first display D1, also partially reaches neighboring pixels of the corresponding pixel. The result is that the image emitted by the second display D2, D3 towards the first display D1 is blurred when reaching the first display D1. Applying the PSF p in the image divider Sd to the output of the spatial low-pass filter Sf corrects for the blurring due to the finite distance between the two displays and improves the image quality. The processor Pr1 further comprises first gamma circuitry $\gamma 1$ to correct the reflection image Ir with an inverse response function $r_1^{-1}$ of the first display D1 and comprises second gamma circuitry $\gamma 2$ to correct the illumination image Ii with an inverse response function $r_2^{-1}$ of the second display D2, D3.

FIG. 4B shows the processing steps as performed by a preferred embodiment of the processor Pr2. The processor Pr2 receives the input image $I_{RGB}$, in which the suffix RGB indicates that the input digital words dw (FIG. 2) of the input image $I_{RGB}$ comprise groups of RGB sub-words which define an RGB color space. The processor Pr2 comprises word splitter Sw which converts the input image $I_{RGB}$ into luminance sub-words Lv and color sub-words C1, C2. The word splitter Sw is constructed to convert the input image $I_{RGB}$ from the RGB color space into (in this example) the HSV color space. In the processor Pr2 the luminance sub-words Lv ("V" indicating the Value in the HSV color space) are split into illumination luminance sub-words Lvi and reflectance luminance sub-words Lvr, using the spatial low-pass filter Sf and the image divider Sd as shown in FIG. 4A. In a preferred embodiment the processor Pr2 further comprises a contrast enhancer Ce to perform contrast enhancement algorithms $f_c$ to the illumination luminance sub-words Lvi and/or a detail enhancer De to perform detail enhancement algorithms $f_d$ to the reflection luminance sub-words Lvr. Next the processor Pr2 comprises word recombiners $Sw^{-1}$ in which the color sub-words C1, C2 are recombined with the illumination luminance sub-words Lvi and the reflection luminance sub-words Lvr respectively. Furthermore, the word recombiners $Sw^{-1}$ convert the groups of HSV color sub-words back into groups of RGB color sub-words generating the illumination image $Ii_{RGB}$ and the reflection image $Ir_{RGB}$. Preferably the processor Pr2 further comprises first gamma circuitry $\gamma 1$ to correct the reflection image $Ir_{RGB}$ with an inverse response function $r_1^{-1}$ of the first display D1 and comprise second gamma circuitry $\gamma 2$ to correct the illumination image $Ii_{RGB}$ with an inverse response function $r_2^{-1}$ of the second display D2, D3.

Figure 5A:
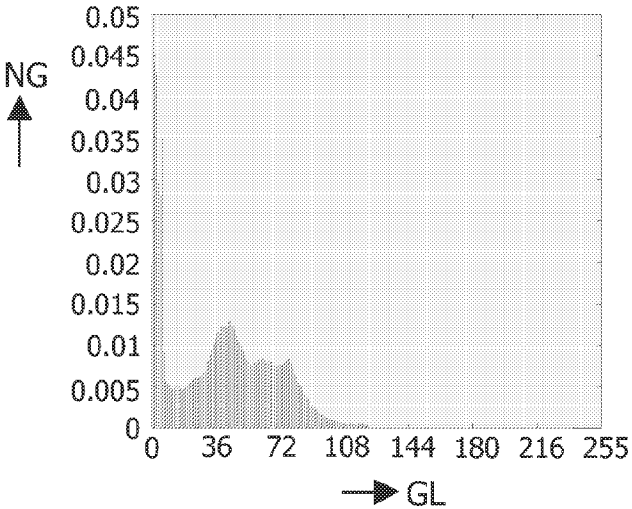
FIGS. 5A to 5C show gray-level histograms of a processed input image displayed at a dual display device with and without performing histogram equalization as image enhancement step.
Figure 5B:
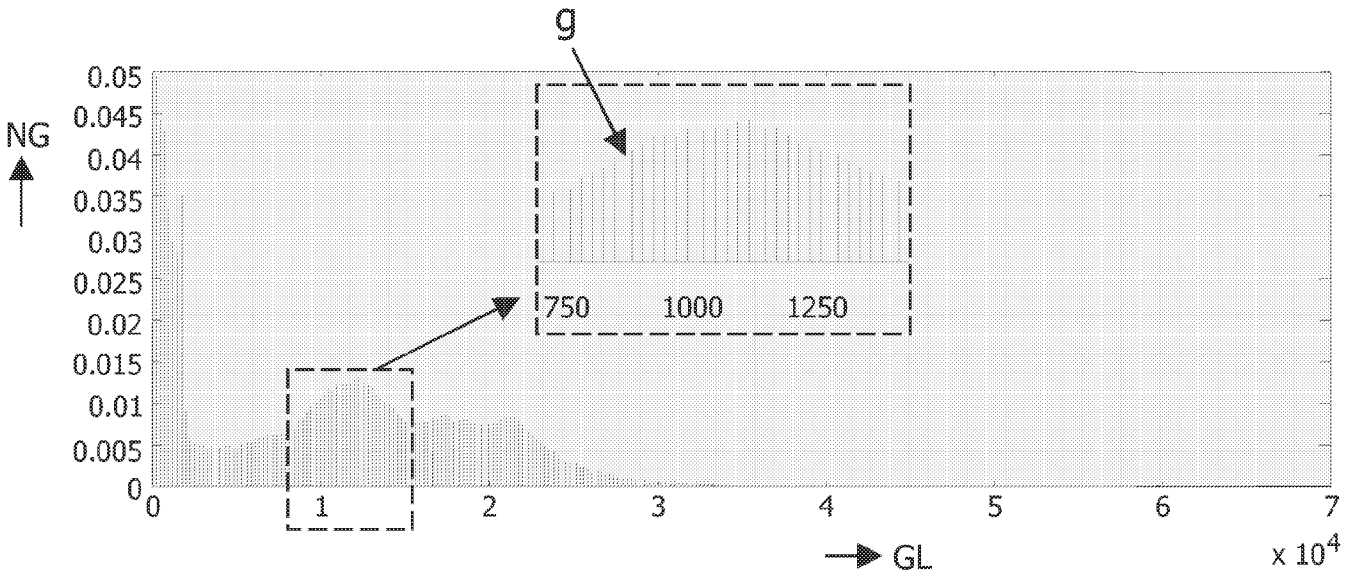
Figure 5C:
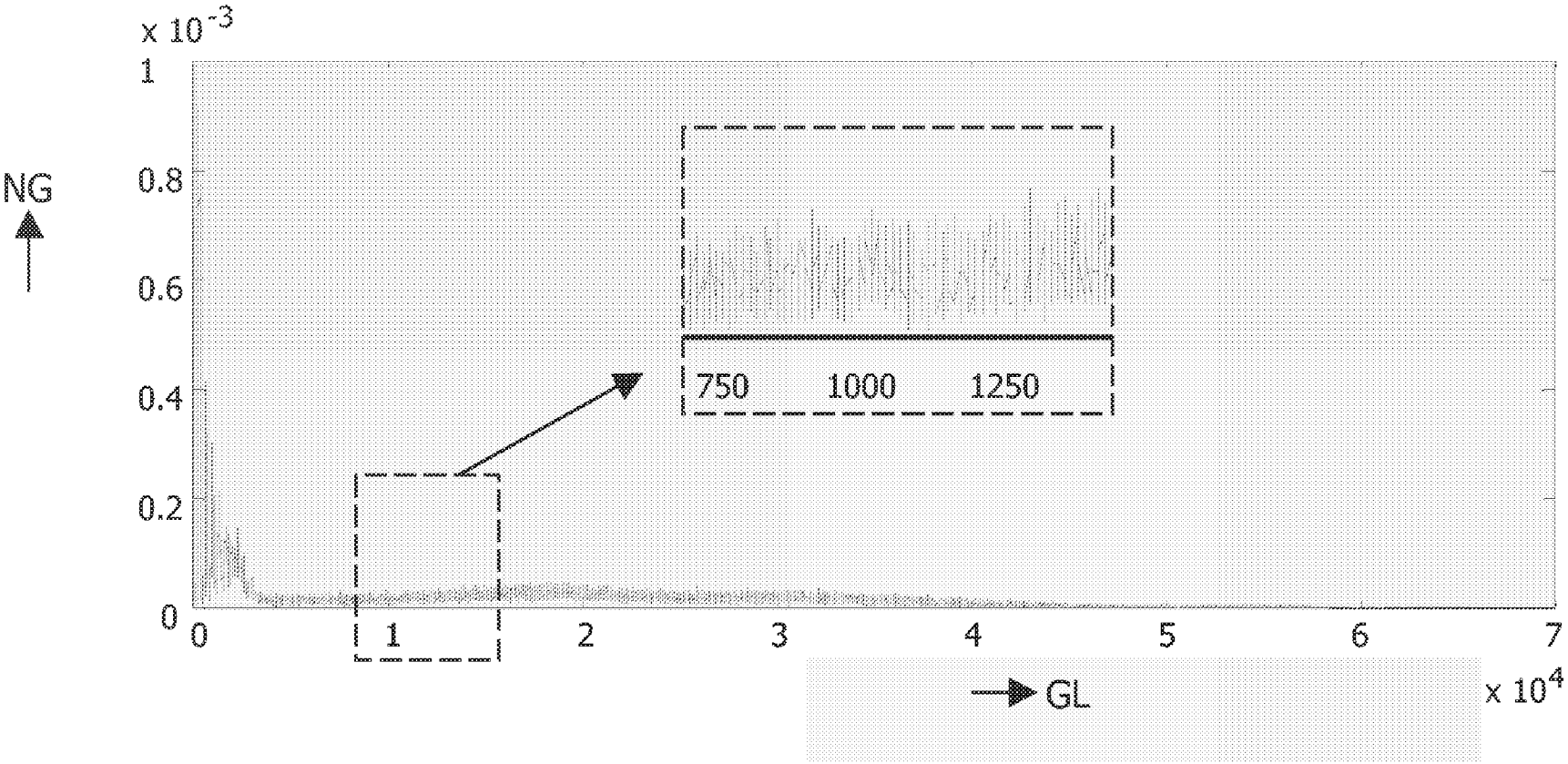

FIGS. 5A to 5C show gray-level histograms. In FIG. 5A a gray-level histogram of an input image I is shown. In FIG. 5B a gray-level histogram of a processed input image I is shown as displayed at a dual display device DD1, DD2 (FIG. 1) without histogram equalization as image enhancement step. In FIG. 5C a gray-level histogram of a processed input image I is shown as displayed at a dual display device DD1, DD2 (FIG. 1) in which histogram equalization is performed as image enhancement step. In a gray-level histogram the number of gray-levels NG which occur within the image is plotted for each of the possible gray-levels GL which the display device is able to display. The gray levels GL which can be displayed on a display device which has a dynamic range of 8 bit typically run from 0 to 255 different gray-levels GL in which the gray-level '0' indicates the utmost dark pixel and the gray-level '255' indicates the utmost bright pixel. The input image I of which the gray-level histogram is shown in FIG. 5A is a relatively dark image, because most of the gray-levels GL mainly cover the lower part of the gray-level histogram.

FIG. 5B shows a gray-level histogram of the input image I as displayed at a dual display device DD1, DD2 without histogram equalization as image enhancement step. In a dual display device DD1, DD2 in which both the first display D1 and the second display D2, D3 have a dynamic range of 8 bits, the theoretical dynamic range typically is 16 bits (65536 different possible gray-levels GL). From the gray-level histogram shown in FIG. 5B it can be seen that the overall shape of the histogram has not been altered significantly. The splitting of the image over the first display D1 and the second display D2, D3 merely seems to stretch the histogram. Another effect when using a dual display device DD1, DD2 for displaying an 8 bit image is that gaps g appear in the stretched gray-level histogram as is indicated in the detailed view in FIG. 5B. These gaps g in the gray-level histogram are caused by the fact that an 8 bit image is split into two images which are reconstructed via a first display D1 and a second display D2, D3 regenerating the original input image I. In the input image I, for example, the gray-levels 16, 17 and 18 are present. After splitting the image and displaying the image using the first display D1 and the second display D2, D3 the gray-levels 16, 17 and 18 are converted into gray-levels 256, 289 and 324 respectively. Although the dual display device DD1, DD2 is capable of distinguishing also all intermediate gray-levels GL between the gray-levels 256, 289 and 324 these intermediate gray-levels GL were not present in the input image and thus will not appear in the image displayed by the dual display device DD1, DD2. Especially in the prior art solution in which two substantially identical images are displayed on the first display D1 and the second display D2, D3 typically 256 different gray-levels GL are shown the image of the dual display device DD1, DD2, showing clear gaps g between the gray-levels GL in the histogram. When using the retinex algorithm for splitting the input image I into the illumination image Ii and the reflection image Ir (as shown in the previous figures) the recombination of the spatially low-resolution illumination image Ii with the reflection image Ir typically will fill part of the gaps g in the gray-level histogram. Thus, applying the retinex algorithm for splitting the input image I enable a more efficient use of the high dynamic range of the dual display device DD1, DD2.

In FIG. 5C a gray-level histogram of a processed input image I is shown as displayed at a dual display device DD1, DD2 (FIG. 1) in which histogram equalization is performed as image enhancement step. The difference of the gray-level histogram shown in FIG. 5B and the gray-level histogram shown in FIG. 5C is that the processor Pr2 (FIG. 4B) performed histogram equalization as detail enhancement algorithm to the reflection image Ir before the reflection image Ir is displayed on the first display D1 and recombined with the illumination image Ii from the second display D2, D3. Histogram equalization redistributes the available gray-levels GL in an image according to a predefined algorithm to obtain a new distribution of gray-levels GL which typically better covers the possible gray-levels GL which can be distinguished by the display. When the histogram equalization is applied to the reflection image Ir two effects result: a first effect gains a further reduction of the gaps g (FIG. 5B) in the histogram and a second effect gains a further stretching of the gray-level histogram towards higher gray-level values. Both effects create gray-levels GL which have not been present in the input image I and thus improve the usage of the dynamic range of the dual display device DD1, DD2. Because the illumination image Ii has not been changed by the processor Pr2, the overall illumination variations within the input image I are substantially preserved. This can be seen in the gray-level histogram of FIG. 5C because still most of the gray-levels GL cover the lower part of the gray-level histogram. This results in a relatively sharper image having a natural illumination. Of course also other detail and/or contrast enhancements algorithms can be applied to the reflection image Ir and/or the illumination image Ii respectively which results in an improved usage of the high dynamic range of the dual display device DD1, DD2.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A dual display device for displaying an input image including input digital words, the dual display device comprising:

a first display, a second display and a processor including an image splitter, the first display modulating an image from the second display, and the image splitter splitting the input image to obtain an illumination image having illumination digital words supplied to the second display and to obtain a reflection image having reflection digital words supplied to the first display, wherein an input digital word of the input digital words includes a group of sub-words together defining a luminance and color of a pixel of the input image, wherein the dual display device further comprises a word splitter for splitting the input digital word into a luminance sub-word representing the luminance of the pixel of the input image and color sub-words representing the color of the pixel of the input image, and wherein the image splitter applies a retinex algorithm only to the luminance sub-words.

2. The dual display device as claimed in claim 1, wherein the image splitter includes a spatial low-pass filter for generating the illumination digital words from the input digital words.

3. The dual display device as claimed in claim 2, wherein the spatial low-pass filter performs a spatial convolution operation on the input digital words using a kernel function.

4. The dual display device of claim 3 wherein, prior to the spatial convolution operation, the input digital words are padded to provide padded borders around an array of the input digital words.

5. The dual display device of claim 4, wherein the padded borders include copies of internal rows and columns of the array of the input digital words.

6. The dual display device as claimed in claim 1, wherein the first display is arranged as an optical filter of programmable transparency for modulating the image from the second display.

7. The dual display device as claimed in claim 1, wherein the image splitter determines the reflection digital words by dividing the input digital word by the corresponding illumination digital word.

8. The dual display device as claimed in claim 1, further comprising a detail enhancer for performing detail enhancement algorithms on the reflection image before being supplied to the first display.

9. The dual display device as claimed in claim 8, wherein the detail enhancer performs histogram equalization.

10. The dual display device as claimed in claim 1, further comprising a contrast enhancer for performing contrast enhancement algorithms on the illumination image before being supplied to the second display.

11. The dual display device as claimed in claim 10, wherein the contrast enhancer performs histogram equalization.

12. The dual display device as claimed in claim 1, wherein the second display is a liquid crystal display.

13. The dual display device as claimed in claim 1, wherein the first display is a liquid crystal display.

14. The dual display device as claimed in claim 1, wherein the first display has a first spatial resolution and the second display has a second spatial resolution, the second spatial resolution being lower than the first spatial resolution.

15. The dual display device of claim 1, wherein the input image comprises red (R), green (G) and blue (B) color space including RGB sub-words, and wherein the processor is configured to convert the input image from the RGB color space to an XYZ color space, wherein X is a value of a luminance sub-word which represents an overall luminance of the RGB sub-words, and wherein Y and Z are values of color sub-words which represent a color component of the of RGB sub-words.

16. A method for displaying an input image including input digital words on a dual display device having a first display, a second display and an image splitter, the first display being arranged for modulating an image from the second display, the method comprising an act of:

splitting the input image to obtain an illumination image having illumination digital words supplied to the second display and to obtain a reflection image having reflection digital words supplied to the first display, wherein an input digital word of the input digital words includes a group of sub-words together defining a luminance and color of a pixel of the input image, wherein the dual display device further comprises a word splitter for splitting the input digital word into a luminance sub-word representing the luminance of the pixel of the input image and color sub-words representing the color of the pixel of the input image, and wherein the image splitter applies a retinex algorithm only to the luminance sub-words.

17. The method of claim 16 wherein, prior to the act of splitting act, further comprising the act of padding the input digital words to provide padded borders around an array of the input digital words.

18. The method of claim 17, wherein the padded borders include copies of internal rows and columns of the array of the input digital words.

19. A tangible computer readable medium embodying non-transitory computer instructions for displaying an input image having input digital words on a dual display device having a first display, a second display and an image splitter, the first display being arranged for modulating an image from a second display, wherein the computer instructions, when executed by a processor, is operative to cause the dual display device to split the input image to obtain an illumination image having illumination digital words supplied to the second display and to obtain a reflection image having reflection digital words supplied to the first display, wherein an input digital word of the input digital words includes a group of sub-words together defining a luminance and color of a pixel of the input image, wherein the dual display device further comprises a word splitter for splitting the input digital word into a luminance sub-word representing the luminance of the pixel of the input image and color sub-words representing the color of the pixel of the input image, and wherein the image splitter applies a retinex algorithm only to the luminance sub-words.

20. The tangible computer readable medium of claim 19 wherein, prior to the split the input image, the computer instructions, when executed by the processor, further cause the dual display device to provide padded borders around an array of the input digital words, wherein the padded borders include copies of internal rows and columns of the array of the input digital words.

* * * * *